United States Patent [19]

Raff et al.

[11] Patent Number: 4,594,984

[45] Date of Patent: Jun. 17, 1986

[54] REGULATION DEVICE FOR THE MIXTURE COMPOSITION OF AN INTERNAL COMBUSTION ENGINE

[75] Inventors: Lothar Raff, Remseck; Hans-Martin Wiedenmann, Stuttgart, both of Fed. Rep. of Germany

[73] Assignee: Robert Bosch GmbH, Stuttgart, Fed. Rep. of Germany

[21] Appl. No.: 755,213

[22] Filed: Jul. 15, 1985

Related U.S. Application Data

[63] Continuation of Ser. No. 708,094, Mar. 4, 1985, which is a continuation of Ser. No. 521,506, Aug. 8, 1983, abandoned.

[30] Foreign Application Priority Data

Aug. 21, 1982 [DE] Fed. Rep. of Germany ..... 3231122

[51] Int. Cl.[4] ..... F02M 7/12; F02B 3/08; F02B 33/00; F02D 5/02

[52] U.S. Cl. ..... 123/440; 123/437; 123/481; 123/436

[58] Field of Search ..... 123/440, 437, 436, 489, 123/339

[56] References Cited

U.S. PATENT DOCUMENTS

| | | | |
|---|---|---|---|
| 4,167,924 | 9/1979 | Carlson et al. | 123/440 |
| 4,178,883 | 12/1979 | Herth | 123/440 |
| 4,355,615 | 10/1982 | Asano et al. | 123/440 |
| 4,364,359 | 12/1982 | Otsuka et al. | 123/440 |
| 4,402,291 | 9/1983 | Aono | 123/440 |
| 4,408,584 | 10/1983 | Labuhara et al. | 123/440 |
| 4,411,236 | 10/1983 | Matsui et al. | 123/440 |
| 4,428,345 | 1/1984 | Bertsch et al. | 123/440 |
| 4,430,979 | 2/1984 | Shikata | 123/440 |

*Primary Examiner*—Raymond A. Nelli
*Attorney, Agent, or Firm*—Edwin E. Greigg

[57] ABSTRACT

A regulating device is proposed for the mixture composition of an internal combustion engine having a signal sensor and having regulating ranges which can be switched over between lambda equals one and the lean range. The lambda-equal-to-one regulation is effected by means of a two-point regulator and the lean regulation is effected either via an altered set-point value of the two-point regulator or with the aid of a steady regulator. The transitions between the two types of regulation take a course dependent on a selectable function, in order to avoid abrupt changes in rpm. A switchover is also made to controlled operation for a brief period at the beginning of each type of regulation.

19 Claims, 26 Drawing Figures

REGULATION DEVICE FOR THE MIXTURE COMPOSITION OF AN INTERNAL COMBUSTION ENGINE

BACKGROUND OF THE INVENTION

This is a continuation of copending application Ser. No. 708,094, filed Mar. 4, 1985, which is a continuation of copending application Ser. No. 521,506, filed Aug. 8, 1983, now abandoned.

The invention is based on a regulating device for the mixture composition of an internal combustion engine having an oxygen sensor, the signal of which makes a jump in the range where lambda equals 1, while at least in a peripheral range the signal behavior of the sensor is steady. Sensors of such a kind are known, for instance, from U.S. Pat. No. 3,514,377. Their signal behavior is characterized by a jump in the range where lambda equals 1 and by signal segments taking a more or less flat course in the peripheral ranges.

A regulating device for the mixture composition of an internal combustion engine is disclosed by German Offenlegungsschrift No. 21 16 097. One of the examples given therein includes an oxygen sensor connected at its output to a low-pass filter and a threshold value switch. With this threshold value switch, the switchover points of the sensor at the transition from a reducing to an oxidizing mixture and vice versa are determined; thus, an average mixture with lambda equal to 1 is established via a two-point regulating device. With a futher sensor, a point is established on one of the two peripheral segments of the characteristic output curve of the oxygen sensor, so that the overall result is that regulating processes take place both for lambda equal to 1 and for lambda not equal to one, preferably lambda equal to from 1.2 to 1.4.

in order to be able to accommodate this wide lambda spectrum in terms of regulating technology, the regulating device of the prior art requires various sensors. This known device, however, is not optimal in terms of attaining mass production at the most favorable cost.

OBJECT AND SUMMARY OF THE INVENTION

With the regulating device according to the invention and as defined hereinafter, a solution to the problem of a mixture regulating device is attained which is both favorable in cost and satisfactory in terms of its functioning.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
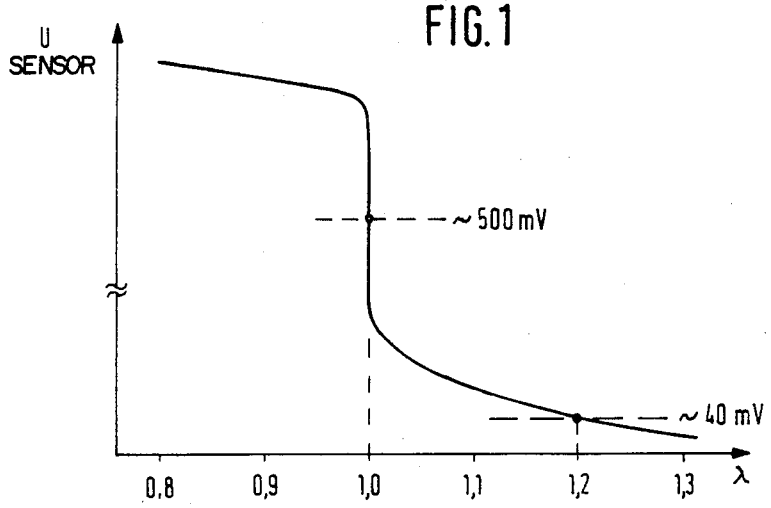
FIG. 1 shows the output signal of an oxygen sensor, plotted over lambda.

In FIG. 1, the output signal of a zirconium dioxide sensor is plotted over lambda. It can be seen that there is a relatively high voltage potential at lambda values below 1.0. At $\lambda=1$, a voltage jump then follows the $\lambda$ characteristic curve and then fades out above $\lambda>1.0$, in the so-called "lean segment" of the signal course. The regulating threshold for the regulation at lambda equals 1 (two-point regulation) is located in the middle of the jump in potential, at approximately 500 millivolts. For the lean regulation, that is, at lambda=1.2, the regulating threshold is at approximately 40 millivolts.

The voltage values, in particular, of the sensor are as a rule very much dependent on temperature in the lean lambda range. Signals capable of being evaluated for regulating purposes therefore require a sensor which is heated up to the most constant possible temperature.

One aspect of the invention is the use of a single, heated sensor both for regulation at lambda equal to 1 and for lean regulation, for instance (lambda=1.2). A reduction of fuel consumption in the partial-load range can thereby be attained with the lean regulation, while with regulation at lambda equal to 1, a reduction in exhaust gases can be attained during idling and above the partial-load range.

With this concept of regulation divided into two parts, particular care must be taken in the transitions between the two kinds of regulation.

Figure 2:
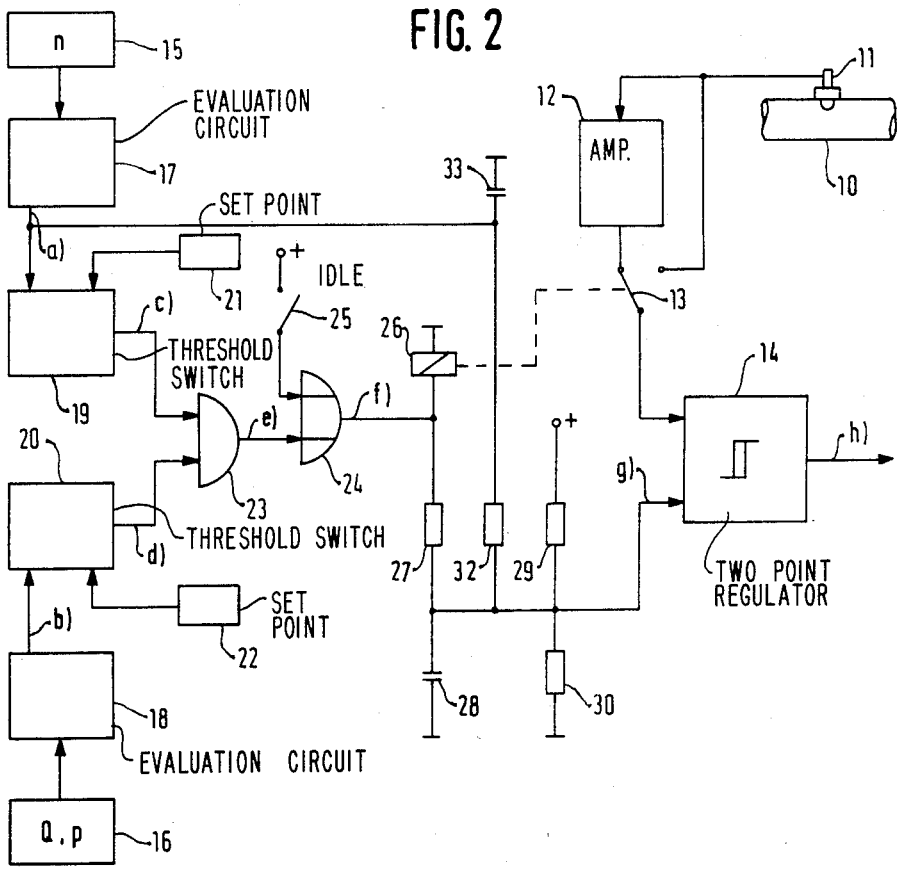
FIG. 2 shows a first exemplary embodiment of the regulating device according to the invention.

FIG. 2 shows a first example of the regulating device according to the invention, with the emphasis being on the circuit components for controlling the switchover between the two kinds of regulation.

In FIG. 2 the drawing includes an exhaust gas tube 10 and an exhaust gas sensor 11. Its output signal travels both directly and indirectly, via an amplifier 12, to an alternating switch 13. The output of the alternating switch 13 in turn is connected to a first input of a two-point or two-state regulator 14, which in turn furnishes a regulating voltage h for a mixture-forming device in the internal combustion engine. This device may be either an injection system or a controllable carburetor system. An rpm sensor (evaluation of the ignition pulses) is marked 15, while a load sensor is marked 16. For evaluating or processing these sensors' signals, the electrical networks 17 and 18 are connected to the output side of the sensors 15 and 16 and are followed in their turn by threshold switches 19 and 20. For example, in U.S. Pat. No. 3,973,529 in FIG. 3 there is shown a similar processing circuit including operational amplifiers for evaluating a voltage that is dependent upon an output variable of an operating parameter of the engine. Such a circuit includes a set-point or reference control, that is, a correction unit, as described in col. 5, lines 5–14 and lines 51 ff., and col. 6, lines 18–26. Also, in U.S. Pat. No. 3,782,347 there is shown a typical threshold switch 11 in FIG. 2, the circuity of which is shown further in FIG. 4 of that patent and described on col. 4, lines 15 ff. These patents are incorporated herein by reference. Both threshold switches 19 and 20 additionally receive comparison signals from set-point control stages 21 and 22. On their output side, the threshold switches 19 and j0 are coupled with an AND gate 23.

An OR gate 24 follows, the second input of which can have a positive signal imposed upon it via an idling switch 25. the output signal of the OR gate 24 controls a relay 26, which actuates the alternating switch 13. A low-pass filter comprising a resistor 27 and a capacitor 28 also leads from the output of the OR gate 24 to the set-point input g of the two-point regulator 14. This set-point input is additionally connected directly with the junction of the voltage divider, comprising two resistors 29 and 30, between the battery voltage connections. A further connection also exists, via a low-pass filter comprising a resistor 32 and a capacitor 33, with the junction of the function generator 17 and the threshold switch 19.

Figure 3:
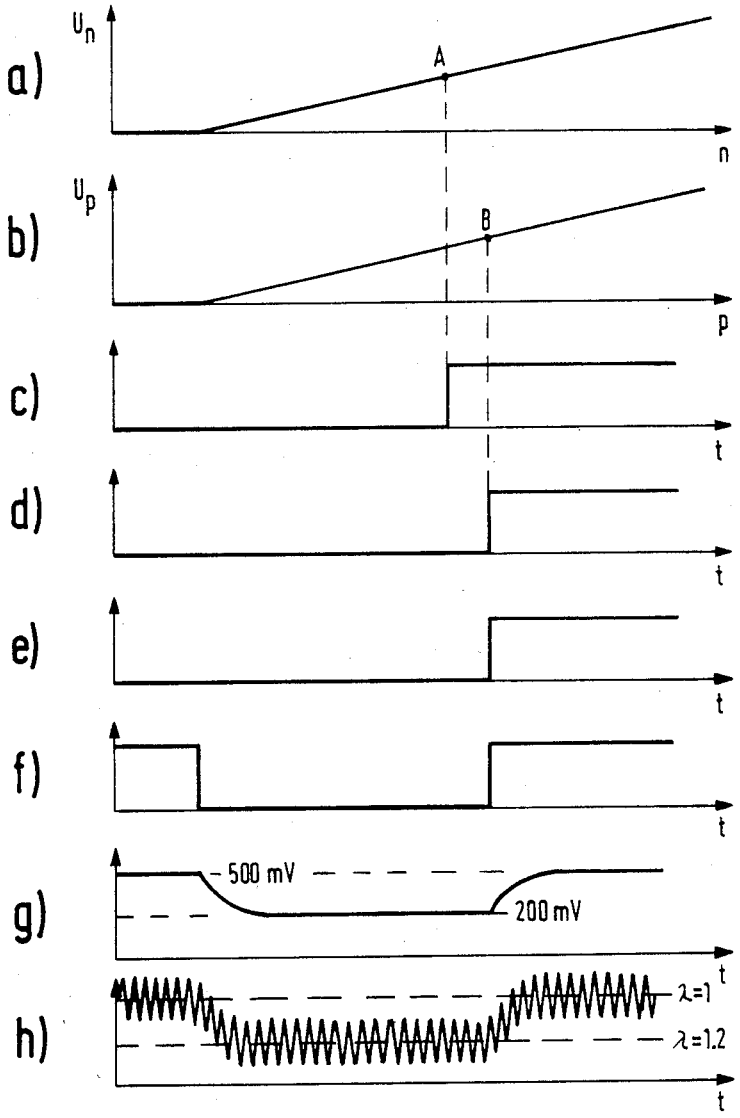
FIGS. 3*a* to 3*b* provide various pulse diagrams explaining the subject to FIG. 2.

The subject of FIG. 2 will now be explained referring to the pulse diagrams of FIG. 3.

FIG. 3*a* shows the output signal of the rpm function network 17. It can be seen that during idling the output signal is zero, and above the idling rpm a linearly rising output signal is produced. The corresponding situation prevails for the load, with FIG. 3*b* showing the output signal of the function network 18. The threshold switches 19 and 20 then emit signals corresponding to FIGS. 3*c* and 3*d*, depending upon their set threshold point. FIG. 3*e* shows the output signal of the AND gate 23 and FIG. 3*f* shows that of the OR gate 24. It is clearly shown that during idling and above the upper partial-load range, the relay 26 is excited, while in the lower and middle partial-load range is not. The following low-pass filter having the resistor 27 and the capacitor 28, in accordance with an e-function provides for the feedback of the various signal flanks of the OR gate 24, so that finally a signal corresponding to FIG. 3*g* is present at the set-point input g of the two-point regulator 14. Lastly, FIG. 3*h* shows the output signal of the two-point regulator 14.

In the idling range (gas pedal in the position of rest), the idling switch 25 is closed; at its input, the OR gate 24 receives positive potential and passes it through to its output. This means that a set-point value is produced for the two-point regulator 14, corresponding to the resistance values of the two resistors 29 and 30. Depending upon the sensor, this may be a value of 500 millivolts, for example. Since at the same time the relay 26 is excited and thus switches the sensor voltage directly to the actual-value input of the two-point regulator 14, the overall result is a lambda-equals-one regulator.

Depressing the drivig pedal causes the idling switch to reopen, and the engine rpm is increased. The output signal at the OR gate 24 drops, and the relay 26 and the alternating switch 13 remain in the unexcited state (that is, the state shown), with the simultaneous result that in signal terms the resistor 27 is now located parallel to the resistor 30, and the set-point value of the regulator 14 is thus reduced to approximately 200 millivolts. This value orients itself at the output of the signal, with the regulating point in the lean segment (40 millivolts), multiplied by the amplification factor of the amplifier 12 (in this case, 5). The two-point regulator 14 then performs regulation in the lean range—for instance at lambda equal to 1.2—to an optimal fuel consumption. The transition from lambda-equal-to-one regulation to the lean regulation and vice versa must take place smoothly, because an abrupt lambda change would result in a substantial and perceptible change in engine speed and thus in an unpleasant ride. Regulation to the optimum for fuel consumption is effected in the lean range until such time as the engine has attained an operating state at which the exhaust-gas values are so high that they must be drastically reduced with a lambda-equal-to-one regulation and with a three-way catalytic converter system.

If at this operating state the two threshold switches 19 and 20 have switched over, then the two inputs of the AND gate 23 receive a positive signal, and a positive signal is thus applied to the input of the OR gate 24. The relay 26 is excited again, and the set-point value at the set-point input g of the two-point regulator 14 again increases to approximately 500 millivolts (FIG. 3*g*) in accordance with an e-function via the low-pass filter comprising the resistor 27 and the capacitor 28.

Figure 4:
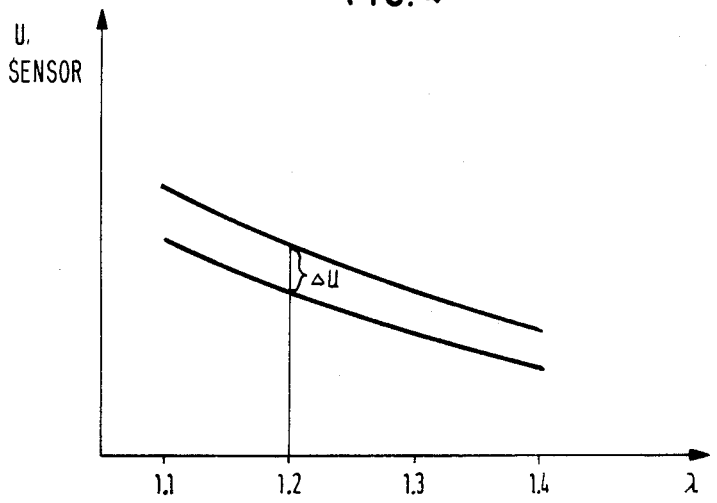
FIG. 4 is a diagram explaining the temperature dependency of the sensor output signal.

The heated sensor is as a rule very stable over a wide temperature range, especially if a PTC heater is used. However, since temperature fluctuations between 300° C. and 800° C. in the exhaust gas sometimes occur (in the partial-load range, the temperature fluctuations are between 300° C. and 500° C.), the characteristic sensor curve is elevated slightly, by a few millivolts, in the hot exhaust gas. This is shown in FIG. 4, in which the output signal of the sensor in the lean range is plotted separately for both a high and a low exhaust-gas temperature value. The difference in the signal amounts to 3 millivolts, by way of example.

Since hot exhaust gas predominantly appears in a delayed fashion as the engine speed increases, the set-point value at the set-point input g of the two-point regulator 14 is elevated in a delayed fashion via the low-pass filter having the resistor 32 and the capacitor 33, and thus the slight influence of temperature on the lambda sensor is compensated for. If the output signals of the two function networks 17 and 18 fall below or fail to attain the established set points of the threshold value switches 19 and 20, then the output signal of the AND gate 23 changes again, so that the final result is again lean regulation in the partial-load range.

Figure 5:
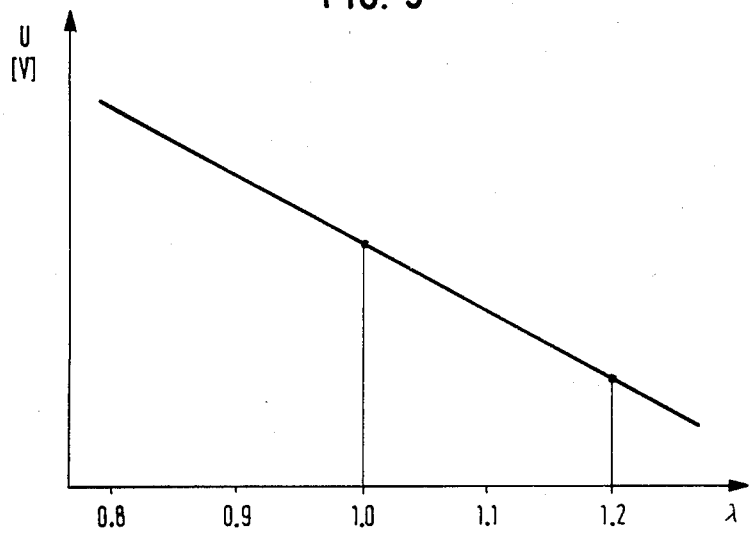
FIG. 5 is a diagram of the trigger signal for the adjusting member dependent upon lambda.

The output of the two-point regulator is carried in a known manner to an adjusting member of a gasoline injection system or a regulated-carburetor system. The voltage for the adjusting members is shown in FIG. 5, wherein it can be seen from the drawing that there is a linear relationship between lambda and the control voltage; this control voltage decreases as the lambda value increases.

Figure 6:
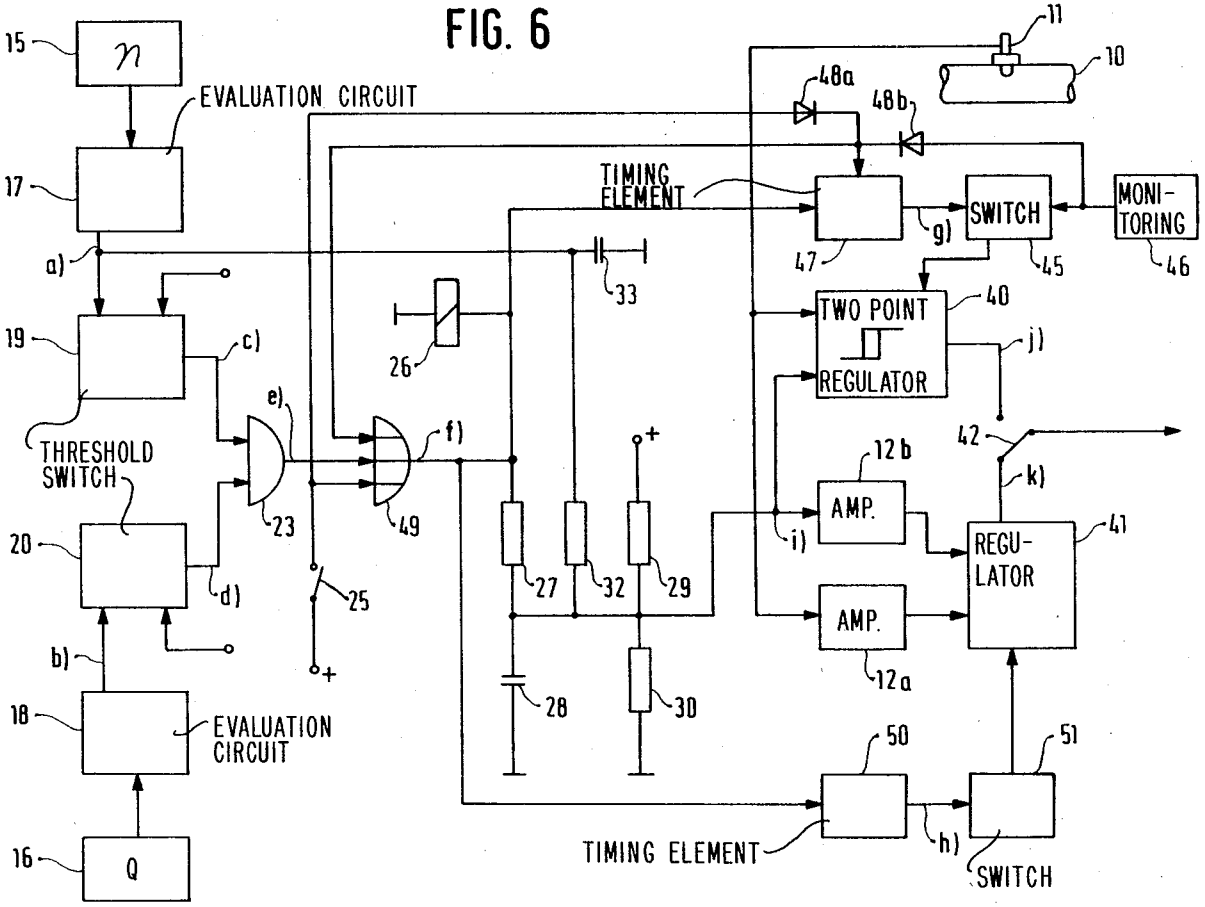
FIGS. 6 and 7*a* to 7*k* show the circuit layout and signal patterns for a second exemplary embodiment of the regulating device according to the invention.
Figure 7:
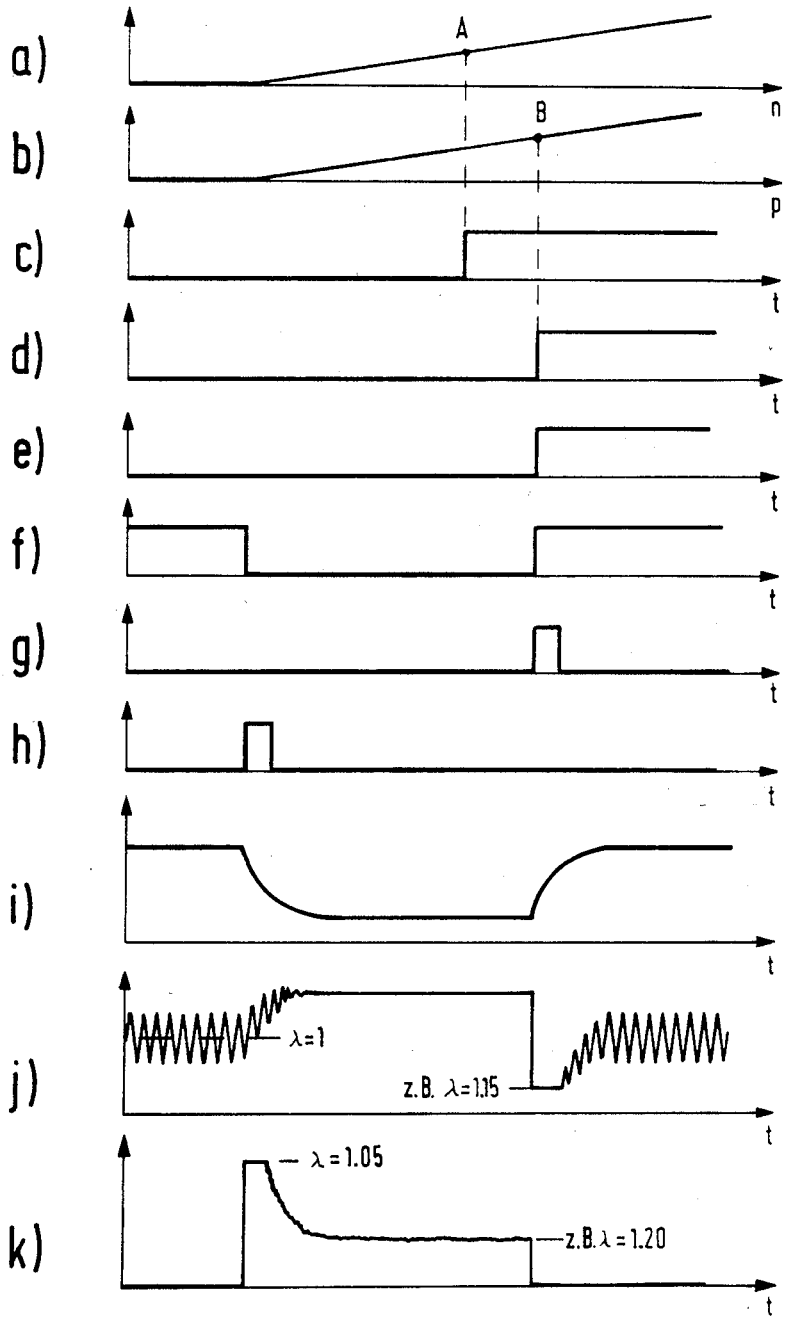

A second exemplary embodiment of the regulating device for the mixture composition of an internal combustion engine according to the invention is shown in FIG. 6. The most important distinction as compared with the subject of FIG. 2 is that in FIG. 2, there is only a single two-point regulator 14, while in the apparatus of FIG. 6 there is both a two-point regulator for lambda equal to one and a steady regulator for lean regulation. A steady regulator and in particular a linear regulator is shown in FIG. 2 of U.S. Pat. No. 3,738,341 and explained on col. 6, lines 63-col. 7, line 2, which patent is incorporated herein by reference. These two regulators are identified by reference numerals 40 and 41. The details of their design are as follows: The sensor 11, as an actual-value transducer, again is connected both directly with the two-point regulator 40 and indirectly via an amplifier 12*a* with the steady regulator 41. The junction of the two resistors 29 and 30 serves to furnish the set-point values for both types of regulator. A further amplifier 12*b* is also connected to the set-point input of the regulator 41. On the output side j, k, the two regulators 40 and 41 are followed by an alternating switch 42 (which can also be used as a semiconductor switch), the output of which in turn forms the output of the entire regulating system. The two-point regulator 40 is assigned a first switching unit 45, which receives input signals from a sensor monitoring stage 46 and from a timing element 47, which is controlled via a diode 48*a* by the input signal of the relay 26 and by the output signal of the idling switch 25. The OR gate 24 of FIG. 2 is embodied as a triple OR gate 49 in the subject of FIG. 6, and this OR gate 49 additionally receives an input signal via a diode 48*b* from the sensor monitoring circuit layout 46. Finally, via a timing element 50 and a switching unit 51, the output signal of this OR gate 49 also controls the steady regulator 41. The subject of FIG. 6 will now be advantageously explained by referring to the signal diagrams provided in FIG. 7, in which the individual signal courses of FIG. 6 are plotted.

In view of the fact that in lean regulation the sensor output signal slopes relatively little, it is advantageous in this case to use a steady regulator, with which greater regulatory precision can be attained. Furthermore, lambda interference variables which deviate from the established set point can be more rapidly regulated away with the steady regulator (41) than with a two-point regulator, since as the deviation increases the slope of the regulator increases as a result of the I-component, and thus to an increased extent acts counter to an undesired air number lambda. This steady regulator cannot be used for lambda-equal-to-one regulation because at lambda equal to one the lambda sensor has a steep voltage jump, and thus the regulator would always be positioned against the lean or the rich stop.

In the idling range or upon actuation of the gas pedal, if the lambda sensor operating temperature is insufficient because of engine roughness, then operation must be based on control at lambda=1. In order to realize this, a positive potential must be applied to the OR gate 49, so that the relay 26 will attract and switch over to the output of the two-point regulator. During idling, this is effected by means of the closed idling switch 25 (whether the sensor is cold or warm), or in the case of an insufficient operating temperature of the lambda sensor and with the idling switch 25 open (that is, when the gas pedal is actuated, by means of the sensor monitoring circuit 46, which emits a positive potential to the OR gate 49.

In both cases, if control is effected to lambda=1, then the timing element 47 must remain ineffective, since with a positive pulse at the output of the OR gate 49, the two-point regulator would be set to lambda=1.5 during the ON time of the timing element 47.

The timing element 47 becomes ineffective first via the diode 48*b* and second by means of the idling switch 25 with a positive potential fed via diode 48*a*. The diodes 48*a* and 48*b* uncouple the signals of the sensor monitor 46 and the idling switch 25.

Figure 8:
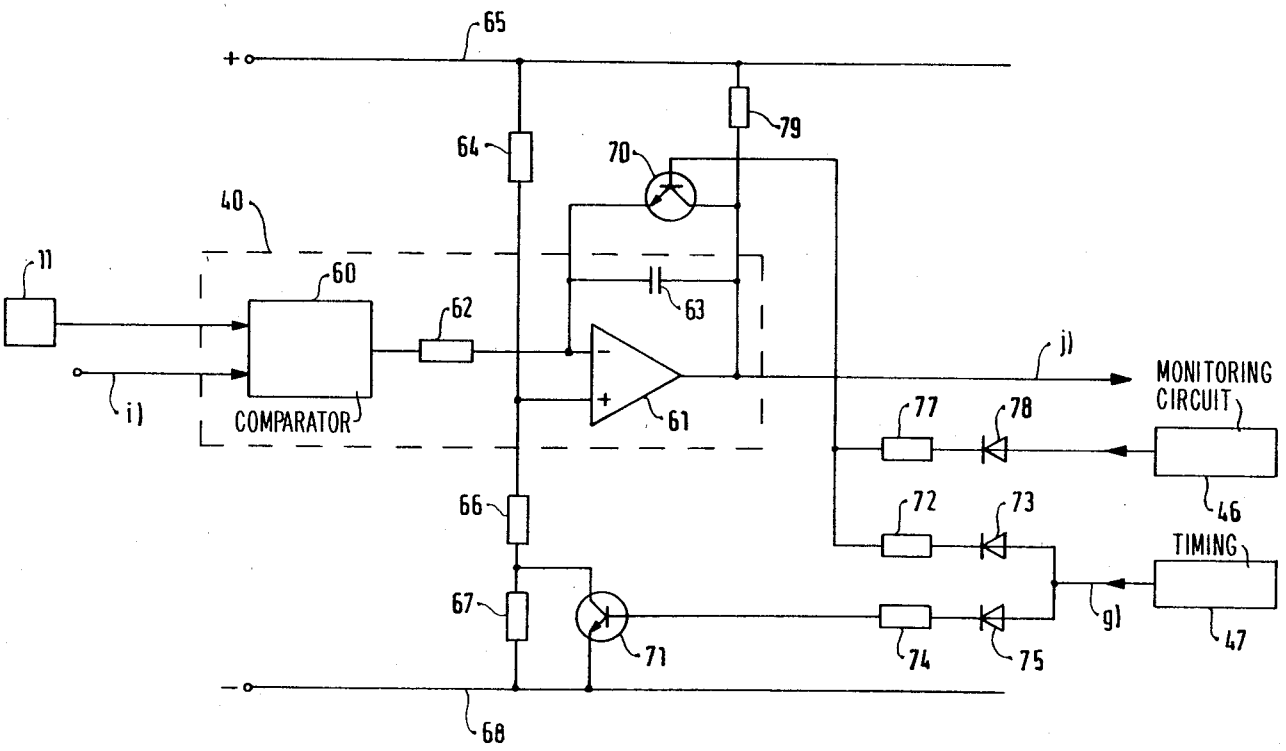
FIGS. 8 and 9 show details of the subject of FIG. 6.

This is accomplished in this exemplary embodiment by circuit details which are shown in FIG. 8. There the two-point regulator 40 includes a comparator 60, which is followed by an operational amplifier 61 equipped as an integrator, which purpose is served by a series resistor 62 as well as a capacitor 63 from the output to the negative input of the operational amplifier 61. On the positive side, this amplifier 61 is connected first via a resistor 64 with a positive lead 65 and further via a series circuit of two resistors 66 and 67 with the negative lead 68. Parallel to the capacitor 63 and the resistor 67, respectively, are respective transistors 70 and 71, which at the base are connected via respective series circuits comprising a resistor and a diode (72–75) with the output of the timing element 47. The transistor 70 can additionally be controlled by the output of the sensor monitoring circuit 46 via a further series circuit of a resistor 77 and a diode 78. Finally, from the output of the operational amplifier 61, as the output of the two-point regulator 40, there is a resistor 79 connected with the positive lead 65.

With a sensor which is not yet operationally ready, the sensor monitoring circuit emits a positive output signal, which directs the transistor 70 of FIG. 8 to be conductive. The transistor 71 remains blocked, because the timing element 47 is not effective. The result at the output then is a voltage which is a product of the voltage divider ratio of resistors 64, 66 and 67. This voltage is selected such that it sets the adjusting member for the mixture to control at lambda equal to one. Once the sensor has attained its operating temperature, after about 30 seconds, and thus provides a usable regulating signal, then the positive output signal of the sensor monitoring circuit is eliminated and the transistor 70 blocks, so that the two-point regulator 40 can then assume its regulating function. Because of the closed idling switch 25 a positive potential arises at the output of the OR gate 49, the set-point value at the two-point regulator 40 is at approximately 500 millivolts; that is, regulation establishes that lambda equals one; see FIG. 7*j*.

Upon the actuation of the gas pedal, the idling switch opens; the output signal at the OR gate 49 collapses, and the relay 26 causes the alternating switch 42 to resume its outset position, shown. The set-point regulation value for the two regulators 40 and 41, because of the low-pass filter comprising the resistor 27 and the capacitor 28, slides down to about 40 millivolts in accordance with an e function (see FIG. 7*i*). Since during lambda-equal-to-one regulation the regulator output of the steady regulator 41 is resting on the lean stop (FIG. 7*k*), the steady regulator 41 must be set for control for a brief period via the timing element 50 and the switching unit 51 (FIG. 7*k*). In order to assure a smooth ride during the transition from lambda-equal-to-one regulation to lean regulation, the steady regulator 41 is not set immediately to the set-point value of lambda=1.2 but instead is set only slightly away from lambda=1.0, in fact to an air number of lambda equal to 1.05, for instance.

Figure 9:
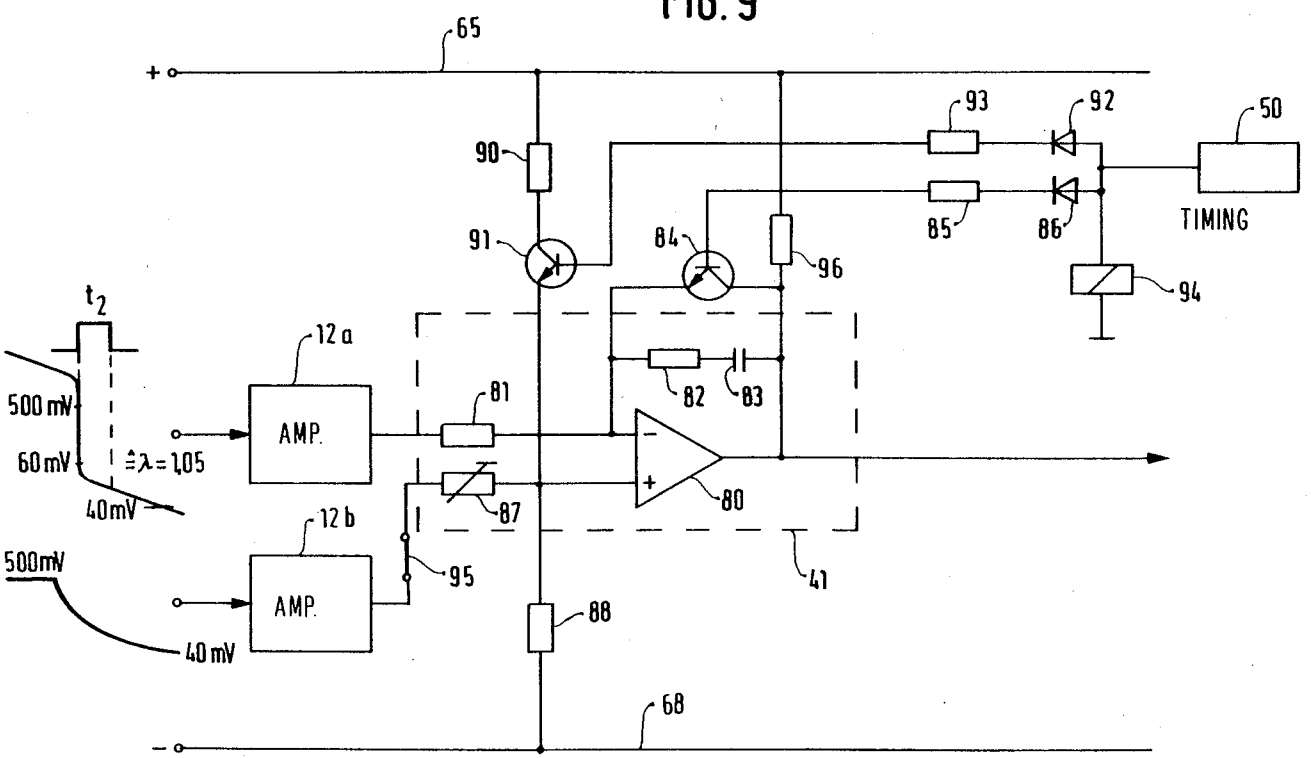

This is accomplished in detail by the subject of FIG. 9. There the steady regulator 41 includes an oprational amplifier 80 equipped as a PI regulator, which has a resistor 81 connected to its input and a series circuit comprising a resistor 82 and a capacitor 83 connected parallel to it. The RC unit comprising elements 82 and 83 is connected parallel to the emitter-collector path of a transistor 84, which at its base is coupled via a resistor 85 and a diode 86 with the output of the timing element 50.

The positive input of the operational amplifier 80 is connected via a resistor 88 with the negative lead 68 and via a series circuit comprising a transistor 91 and a resistor 90 with the positive lead 65. The transistor 91 is likewise controlled by the timing element 50 via a diode 92 and a resistor 93. A further resistor 96 also leads from the output of the operational amplifier 80 to the positive lead 65. Between the output of the timing element 50 and ground there is also a relay 94, whose normally closed contact pair is located in the line leading from the amplifier 12*b* and the regulator 41.

During the short control time immediately following the period of idling which is apparent from FIG. 7*k*, the timing element 50, with a positive pulse, controls the transistors 84 and 91 to make them conductive, and the relay 94 (or semiconductor switch) attracts and opens the contact 95. As a result, not only does the regulator 41 become ineffective but also a voltage potential is formed at the positive input of the operational amplifier 80, because of the conductive transistor 91. This voltage divider ratio is then selected such, being 5 V for instance, that the adjusting member connected to the regulator output is triggered with a lambda value = 1.05. After the period of time determined by the timing element 50 has elapsed, the two transistors 84 and 91 block once again; the relay 94 drops and closes its contact 95, so that the steady regulator 41 can regulate about a working point which is low in terms of voltage, which point is then formed by the voltage divider comprising the resistors 87 and 88 and the amplifier 12*b*. Next the steady regulator 41 is guided by the sliding set-point value via the factor-of-20 amplifier 12*b* to a regulator working point of about 400 millivolts (FIG. 7*k*). This is because the amplification factor of the amplifier 12*a* amounts to 10 and the sensor voltage at this point of the lean segment amounts to 40 millivolts. The set-point value is thus amplified by 20 times, so that the precise set-point value, namely 400 mV, can be balanced out with the resistor 87.

Within the uncritical partial-load range, the engine is regulated during lean operation to optimal fuel consumption with low exhaust-gas values, until the two threshold switches 19 and 20 (FIGS. 7*c* and 7*d*) change their output signal, which means that with lambda-equal-to-one regulation there is a need to reduce the toxic components in the exhaust gas. If this is the case, then a positive potential exists at the output of the AND gate 23 and the OR gate 49, and the relay 26 switches the alternating switch 42 back into the position of the two-point regulator 40. However, since the regulator output of the two-point regulator is resting on the rich stop during lean regulation (FIG. 7*j*), the output of the two-point regulator 40 must be set to control for a brief period, via the timing element 47 and the switching unit 45 (FIG. 8). In order again to assure a smooth transition, in terms of the comfort of the ride, from lean regulation to lambda-equal-to-one regulation, the output of the two-point regulator 40 must not be set immediately to lambda = 1. Instead, it must be set to a value slightly away from lambda = 1.2, for instance to lambda = 1.15. To this end, referring to FIG. 8, the transistors 70 and 71 are triggered with a positive pulse in the switching unit 45 via the timing element 47, which is triggered by the output of the OR gate 49. The conductive transistor 71 bypasses the resistor 67 and thus a voltage is established at the regulator output which is determined by the voltage divider comprising the resistors 64 and 66. This voltage is selected such that the following adjusting member is capable of triggering an air number of lambda = 1.15.

If the established period of time of the timing element 47 has elapsed (FIG. 7*j*), then the two transistors 70 and 71 in the switching unit 45 block, so that the two-point regulator can perform regulation about a working point which is higher in terms of voltage, this point then being the product of the voltage divider comprising the resistors 64, 66 and 67. The two-point regulator 40 then follows the sliding set-point value, depending on the design of the resistor 27 and the capacitor 28, in accordance with an e function, to the regulatory working point of 500 mV, so that a lambda-equal-to-one regulation is possible (FIGS. 7*i* and 7*j*). High exhaust-gas values emitted by the engine are drastically reduced by the three-way catalyst system.

The reverse signal pattern results if the rpm and load again fall below the upper rpm and load ranges, as a result of which the threshold switches 19 and 20 switch back once again.

The two exemplary embodiments above relate to the essentials of the regulating device according to the invention for the mixture composition of an internal combustion engine, with elements which are self-evident in present-day technology, such as a low-pass filter following the sensor 11, having been left out.

What is important, however, as compared with the previously known art is that below and/or above the partial-load range toxic exhaust gases are substantially reduced with a lambda-equal-to-one regulation and a catalyst system, and that in the uncritical partial-load range optimal fuel consumption is attainable with a lean regulation. The transition between the two types is smooth according to the invention, in order to prevent severe fluctuations in engine speed.

By means of heating a lambda sensor, the lean segment of the sensor characteristic curve becomes sufficiently stable, so that a temperature compensation via the rpm of the engine is necessary only under some circumstances and can be accomplished with a simple RC element (FIG. 4). For the lambda-equal-to-one regulation, no temperature compensation is required, because then the sensor in any case functions with a precision in the parts-per-thousand range.

The exemplary embodiments discussed herein have been described in terms of analog circuit technology. What appears essential is that the invention does not depend on the type of signal processing, whether digital or analog; it can thus be realized with digital means as well, or with a computer It is also important to note that a controlled leanness concept, that is, one which is controlled via a performance graph (rpm, pressure, air flow rate, ignition), is influenced by atmospheric changes (air pressure, temperature, humidity) as well as by fluctuations in fuel quality.

With a $\lambda$ sensor ($\lambda = 1$ and lean sensor), the exact oxygen concentration in the exhaust gas can be determined directly, so that this value can be put to use as a regulating variable for the purpose of maintaining an optimal combustion setting.

It has also proved to be advantageous, during lean regulation in the lower partial-load range, not to regulate to a fixed value for $\lambda$ (for instance, $\lambda = 1.2$) but instead to guide a complete $\lambda$ performance graph via rpm and pressure (load) as a set-point variable via microprocessors.

It is furthermore advantageous, during the transition from lambda-equal-to-one regulation to lean regulation, for the ignition or an entire ignition performance graph to be adjusted such that it is possible to operate the vehicle with good engine smoothness until far into the lean range.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A regulating device for controlling the mixture composition of an internal combustion engine having an oxygen sensor whose typical characteristic output signal is substantially linear in the vicinity of lambda equal to stoichiometric or 1 and has a steep gradient within a given voltage range, and varies therefrom in a rich peripheral range below stoichiometric and in a lean peripheral range above stoichiometric and has a shallow gradient in the peripheral ranges, comprising:

a two-point regulator means wherein the integral term output decreases with a constant slope when the air/fuel ratio is rich, and the integral term output increases with a constant slope when the air/fuel ratio is lean, said regulator means including an actual value input and a reference value input for providing a regulating mixture signal at its output;

a means for producing a set of discrete reference values for said regulator means wherein said reference values correspond to such values of said output signal which belong to the lean peripheral range above stoichiometric and to the stoichiometric range of said output signal;

a means for selecting one of said reference values as an input to said reference value input of said regulating means in dependence on the engine parameters of speed and load; and a means for amplifying said output signal above stoichiometric to a usable signal magnitude for said actual value input to said regulator means, whereby said regulator means processes the lean peripheral range of said output signal.

2. A regulating device for controlling the mixture compostition of an internal combustion engine having an oxygen sensor whose typical characteristic output signal is substantially linear in the vicinity of lambda equal to stoichiometric or 1 and has a steep gradient within a given voltge range, and varies therefrom in a rich peripheral range below stoichiometric and in a lean peripheral range above stoichiometric and has a shallow gradient in the peripheral ranges, comprising:

a regulator means including an actual value input and a reference value input for providing a regulating mixture signal at its output;

a means for producing a set of discrete reference values for said regulator means, wherein said reference values correspond to such values of said output signal which belong substantially to at least the lean peripheral range above stoichiometric and to the stoichiometric range of said output signal;

a means for selecting one of said reference values as an input to said reference value input of said regulating means in dependence on the engine parameters of speed and load; and a means for amplifying said output signal above stoichiometric to a usable signal magnitude for said actual value input to said regulator means, whereby said regulator means processes the lean peripheral range of said output signal.

3. A regulating device for controlling the mixture composition of an internal combustion engine having an oxygen sensor whose typical characteristic output signal is substantially linear in the vicinity of lambda equal to stoichiometric or 1 and has a steep gradient within a given voltage range, and varies therefrom in a rich peripheral range below stoichiometric and in a lean peripheral range above stoichiometric and has a shallow gradient in the peripheral ranges comprising:

a PI regulator means including a comparator means and an integrator means, said regulator means having an actual value input and a reference value input for providing a regulating mixture signal at its output;

a means for producing a set of discrete reference values for said regulator means, wherein said reference values correspond to such values of said output signal which belong substantially to at least the lean peripheral range above stoichiometric and to the stoichiometric range of said output signal;

a means for selecting one of said reference values as an input to said reference value input of said regulating means in dependence on the engine parameters of speed and load; and a means for amplifying said output signal above stoichiometric to a usable signal magnitude for said actual value input to said regulator means, whereby said regulator means processes the lean peripheral range of said output signal.

4. A method for controlling the mixture composition of an internal combustion engine having a PI regulator means including an actual value input and a reference value input thereto for providing a control signal output, an oxygen sensor connected to said actual value input of said regulator means whose typical characteristic output signal is substantially linear in the vicinity of lambda equal to stoichiometric or 1 and has a steep gradient within a given voltage range, and varies therefrom in a rich peripheral range below stoichiometric and in a lean peripheral range above stoichiometric and has a shallow gradient in the peripheral ranges, comprising the steps of producing a set of discrete reference values for said PI regulator means wherein said reference values correspond to such values of said output signal which belong to the lean peripheral range above stoichiometric and to the stoichiometric range of said output signal, selecting one of said reference values for said reference value input to said regulator means in dependence on the engine parameters of speed and load, and amplifying said output signal above stoichiometric to usable signal magnitude for said actual value input to said regulator means when one of said reference values is selected, whereby said regulator means processes the leans peripheral range of said output signal.

5. A regulating device as defined by claim 2, wherein during idling the stoichiometric portion of said sensor output signal is processed by said regulating means for providing a two-state regulation of said mixture signal.

6. A regulating device as defined by claim 2, wherein beyond an upper partial-load range the stoichiometric portion of said sensor output signal is processed by said regulating means for providing a two-state regulation of said mixture signal.

7. A regulating device as defined by claim 2, wherein for a lower and middle partial-load range the rich peripheral range of said sensor output signal is processed by said regulating means for providing a steady regulation of said mixture signal.

8. A regulating device as defined by claim 2, further comprising means for controlling transitions between said reference values.

9. A regulating device as defined by claim 8, wherein said transitions between said reference values are characterized by a signal curve in accordance with an exponential function.

10. A regulating device as defined by claim 2, wherein said regulating means comprises a two-state regulator having means for a controllable threshold.

11. A regulating device as defined by claim 2, wherein said regulating means comprises a two-state regulator and a linear regulator.

12. A regulating device as defined by claim 8, wherein said means for controlling the transition between said reference values includes means for controlling threshold values.

13. A regulating device as defined by claim 8, further comprising a means responsive to a change in regulation of said sensor output signal by said regulating means for switching over to a controlled operation of the mixture composition.

14. A regulating device as defined by claim 2, further comprising a means in accordance with at least load and rpm for controlling and regulating a λ performance graph storage means for providing said reference values of λ.

15. A regulating device as defined by claim 2, wherein during λ changes the ignition angle is variable.

16. A regulating device as defined by claim 8, wherein said regulating means comprises a two-state regulator having a controllable threshold.

17. A regulating device as defined by claim 8, wherein said regulating means comprises a two-state regulator and a linear regulator.

18. A regulating device as defined by claim 8, further comprising a means in accordance with at least load and rpm for controlling and regulating a λ performance graph storage means for providing said reference values of λ.

19. A regulating device as defined by claim 8, wherein during λ changes the ignition angle is variable.

* * * * *